US006888461B2

(12) United States Patent
Houde

(10) Patent No.: US 6,888,461 B2
(45) Date of Patent: May 3, 2005

(54) FIBER OPTIC BASED SECURITY SYSTEM

(75) Inventor: Claude Houde, Saint-Ambroise-de-Kildare (CA)

(73) Assignee: Entreprises Lokkit Inc., Quebec (CA)

( * ) Notice: Subject to any disclaimer, the term of this patent is extended or adjusted under 35 U.S.C. 154(b) by 115 days.

(21) Appl. No.: 10/095,650

(22) Filed: Mar. 11, 2002

(65) Prior Publication Data

US 2002/0130776 A1 Sep. 19, 2002

(30) Foreign Application Priority Data

Mar. 13, 2001 (CA) ..... 2340533

(51) Int. Cl.[7] ..... G08B 13/18
(52) U.S. Cl. ..... 340/555; 340/568.1; 340/541
(58) Field of Search ..... 340/555, 556, 340/557, 568.1, 541, 571; 250/227.15; 385/115

(56) References Cited

U.S. PATENT DOCUMENTS

| | | | | | |
|---|---|---|---|---|---|
| 4,095,872 | A | | 6/1978 | Stieff et al. | 350/96.24 |
| 4,161,348 | A | | 7/1979 | Ulrich | 350/96.2 |
| 4,275,294 | A | | 6/1981 | Davidson | 250/227 |
| 4,399,430 | A | | 8/1983 | Kitchen | 340/550 |
| 4,420,253 | A | | 12/1983 | Pryor | 356/237 |
| 4,447,123 | A | | 5/1984 | Page et al. | 350/96.24 |
| 4,523,186 | A | * | 6/1985 | Fiarman | 340/555 |
| 4,920,334 | A | * | 4/1990 | DeVolpi | 340/568.4 |
| 5,003,292 | A | | 3/1991 | Harding et al. | 340/568 |
| 5,055,827 | A | | 10/1991 | Philip | 340/568 |
| 5,134,386 | A | | 7/1992 | Swanic et al. | 340/541 |
| 5,202,673 | A | | 4/1993 | Conrad | 340/524 |
| 5,231,375 | A | * | 7/1993 | Sanders et al. | 340/568.2 |
| 5,262,639 | A | | 11/1993 | Vokey et al. | 250/227.15 |
| 5,355,250 | A | | 10/1994 | Grasso et al. | 359/341 |
| 5,408,213 | A | * | 4/1995 | Ungarsohn | 340/427 |
| 5,471,197 | A | | 11/1995 | McCurdy et al. | 340/573 |
| 5,525,796 | A | | 6/1996 | Haake et al. | 250/227.15 |
| 5,567,933 | A | | 10/1996 | Robinson et al. | 250/227.15 |
| 5,592,149 | A | | 1/1997 | Alizi | 340/550 |
| 5,617,073 | A | | 4/1997 | Wilson | 340/568 |
| 5,650,766 | A | * | 7/1997 | Burgmann | 340/539.11 |
| 5,945,668 | A | | 8/1999 | Davidson | 250/227.15 |

* cited by examiner

*Primary Examiner*—Anh V. La
(74) *Attorney, Agent, or Firm*—Merchant & Gould P.C.

(57) ABSTRACT

A fiber optic based security system is disclosed, including a light emitter, a light detector, an optical fiber and a threshold detector. Light is injected at one end of the optical fiber and received at the other end. The optical fiber is looped or secured about an object to be protected. If someone attempts to steal the object by tampering with the optical fiber or cutting it altogether, the light received at the light detector will fall below a predetermined threshold. When this happens, the threshold detector is adapted to trigger an alarm, alerting the proper persons of the theft. Preferably, the system is contained in a portable housing, and the system is preferably useful for protecting objects located outside a building, such as a trailer, bicycle, motorcycle, snowmobile, etc., where conventional security systems would be prohibitive to install.

13 Claims, 5 Drawing Sheets

FIBER OPTIC BASED SECURITY SYSTEM

FIELD OF THE INVENTION

The present invention relates to a compact and practical security system using fiber optics.

BACKGROUND OF THE INVENTION

Security systems are well known in the art, and come in a variety of configurations. In a basic configuration, a security system includes a sensor and a warning system so that when the sensor is triggered, the warning system is activated.

One of the drawbacks with conventional security systems is that they are well adapted to protect for instance the inside of a building, such as a house, factory, warehouse, etc. Such systems include infra-red detectors, motion sensors, contact switches, etc., connected to a central location. When one or more of the sensors is triggered, an alarm, either visual or audible or both, is activated in order to give the proper authorities the time to respond appropriately.

At times, objects to be protected are located outside a building. This is the case of trailers, snowmobiles, bicycles, for example, and other items which can be located outside of a building. In order to protect those items, either a sometimes prohibitively expensive perimeter security system must be installed, or motion sensors can be used. The disadvantage of motion sensors is that they are triggered not only by potential thieves, but also by animals, thereby giving off false alarms.

SUMMARY OF THE INVENTION

It is an object of the present invention to provide an optical fibre based security system which provides an inexpensive alternative to existing security systems. In accordance with the invention, this object is achieved with a fibre optic based security system, comprising:

- a length of optical fibre having two opposite ends;
- a light emitter optically coupled to one of the opposite ends of said fibre for injecting light therein;
- a light detector optically coupled to the other of said opposite ends of the fibre for detecting a level of light transmitted by said fibre;
- threshold means connected to said light detector for determining if the level of light transmitted by the fibre is below a predetermined threshold level;
- a power source for powering said system; and
- an alarm operatively associated with said threshold means, said alarm being triggered when said level of light transmitted by said fibre falls below the threshold level.

BRIEF DESCRIPTION OF THE DRAWINGS

The present invention and its advantages will be more easily understood after reading the following non-restrictive description of preferred embodiments thereof, made with reference to the following drawing in which.

DESCRIPTION OF PREFERRED EMBODIMENTS OF THE INVENTION

Figure 5:
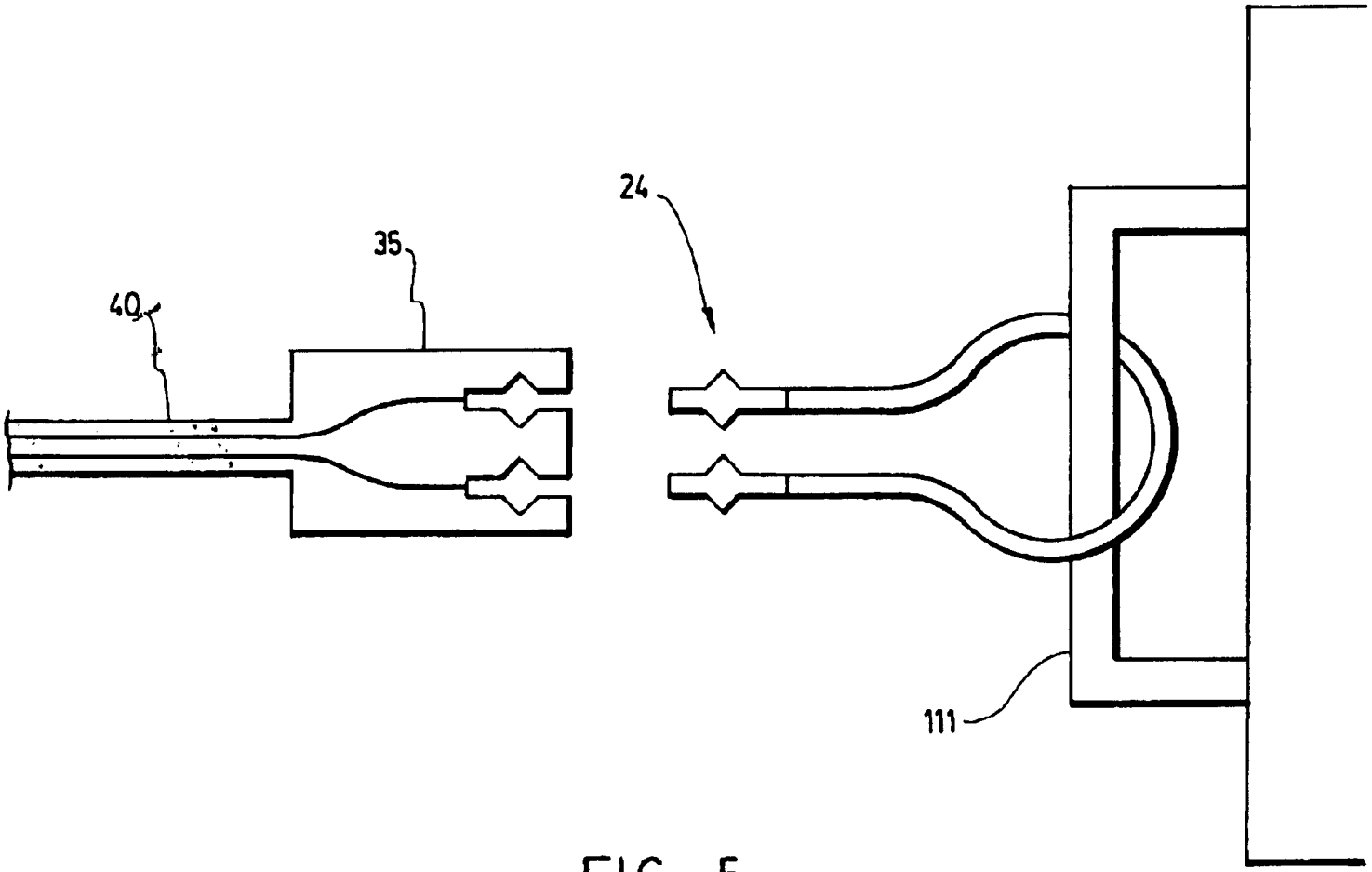
FIG. 5 is a schematic representation of the system of the present invention looped around an object to be protected.

Stated generally, the present invention uses light propagating in a loop of optical fibre as a means to protect an article from theft. The fibre is looped around the article in a manner that the article cannot be removed without breaking the fibre, such as shown in FIG. 5. At one end of the loop, a light source emits light into the fibre, and at the other end a photoreceptor receives the light after its travel in the fibre. The photoreceptor is also linked to an alarm system, or threshold means, which is activated if the light received is lower than a pre-defined threshold. Consequently, should somebody attempt to steal the object that is to be protected by cutting the optical fibre, or by tampering with it resulting in a decrease in the intensity of light transmitted, the alarm system is immediately activated. Advantageously, all the components of the invention with the exception of the fibre loop, are conveniently included in a single casing.

Figure 1:
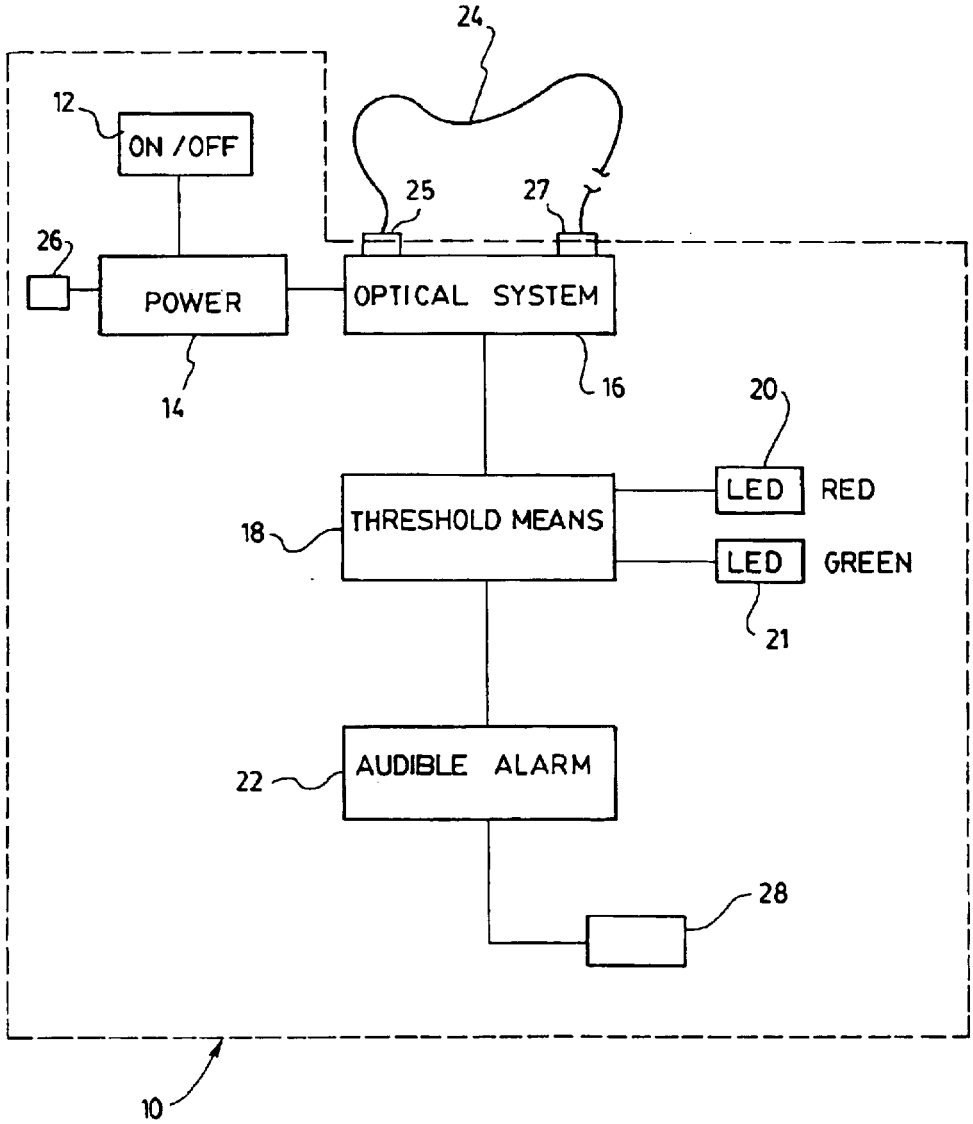
FIG. 1 is a schematic representation of the security system according to a preferred embodiment of the invention.

Referring to FIG. 1, there is shown a schematic representation of the system 10 according to a preferred embodiment of the present invention. The system 10 first includes a fiber loop 24, defining an input branch and an output branch. The input branch is connected to a light emitter 25, for example a LED, which is operatively connected to appropriate electronics. The output branch is connected to a light detector 27. In this manner, if the integrity of the fiber loop is compromised, the light level received at the light detector 27 will be lowered. A logic detector system 18 to detect tampering of the fiber loop 24 is provided, and is connected both to the detector 27 and either an audible alarm 22 or a visual alarm 20 or both. The alarm 20, 22 is activated if the light level at the detector is lower than a predetermined threshold. Preferably, the logic system 18 is connected to green LED 21, which indicate if the system is activated or not. The system 10 is preferably powered by an ordinary power outlet 26 to which is connected an AC/DC converter. A battery or set of batteries may be provided as a backup power source. An ON/OFF switch 12 is also provided.

Alternatively, the light can be emitted according to a predetermined or random pattern. If the light received at the detector is different in pattern or amplitude, then the alarm will be different.

In a preferred embodiment of the invention, the optical fibre is made of plastic or glass. Furthermore, a LED 21 may further be provided for indicating proper functioning of the system and power of the system.

Figure 2:
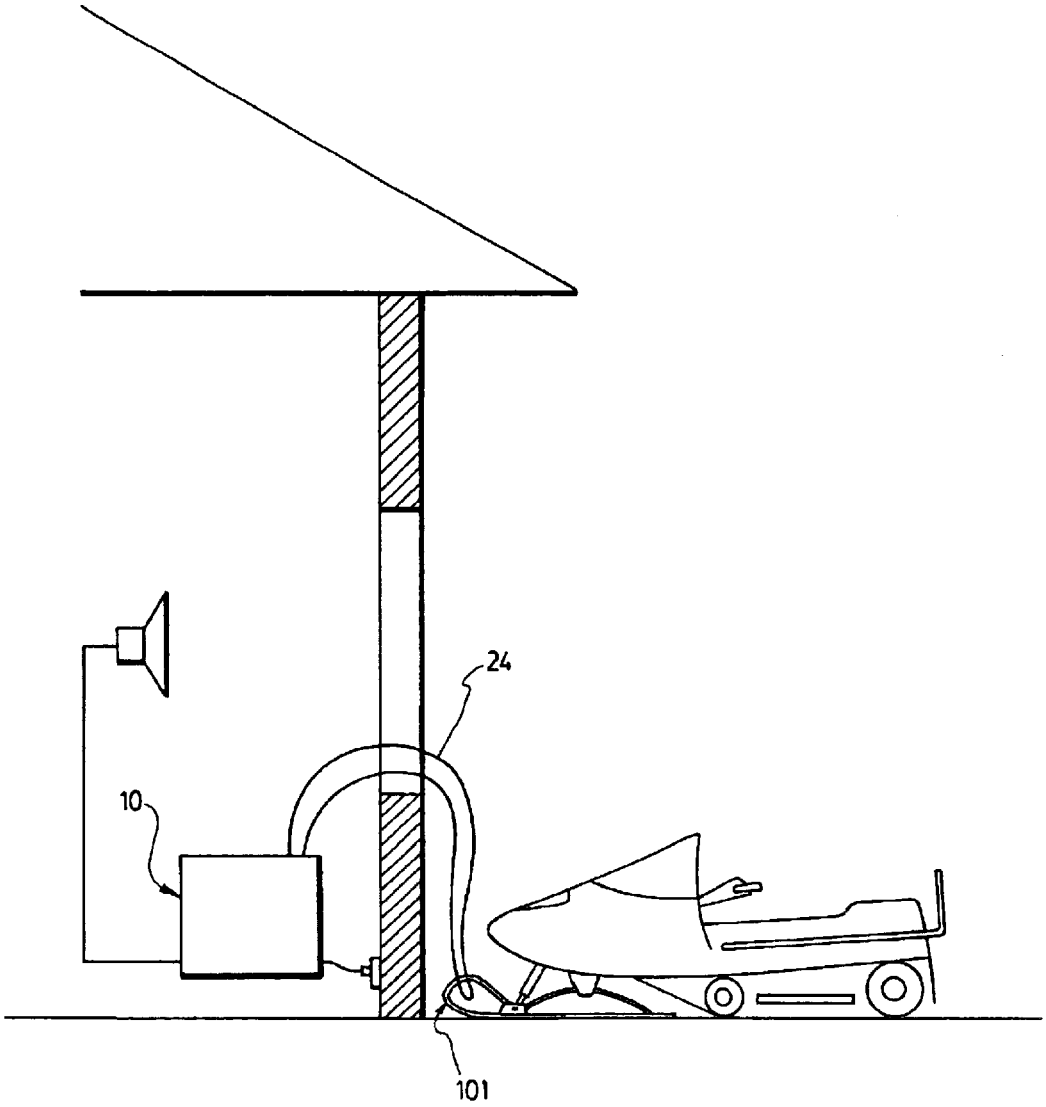
FIG. 2 is a schematic representation of the security system of FIG. 1 used to protect a snowmobile.

Referring to FIGS. 2 and 5, there is shown a preferred embodiment of the fiber optic loop 24. The loop 24 is wrapped around a portion 101, 111 of an article to be protected. The article in question may advantageously be stored outdoors, such as for example a bicycle, a motorcycle, camping equipment, a lawnmower, etc. In a preferred embodiment of the invention, the two branches of the fibre 24 are preferably connected to a connector 38, from which they emerge bundled together and protected by a sleeve 40. The length of the branches is preferably long enough to span the distance from the object to be protected and a neighbouring residence or other power source. The branches are again separated so that they may be connected to the emitter 25 and detector 27.

Figure 4:
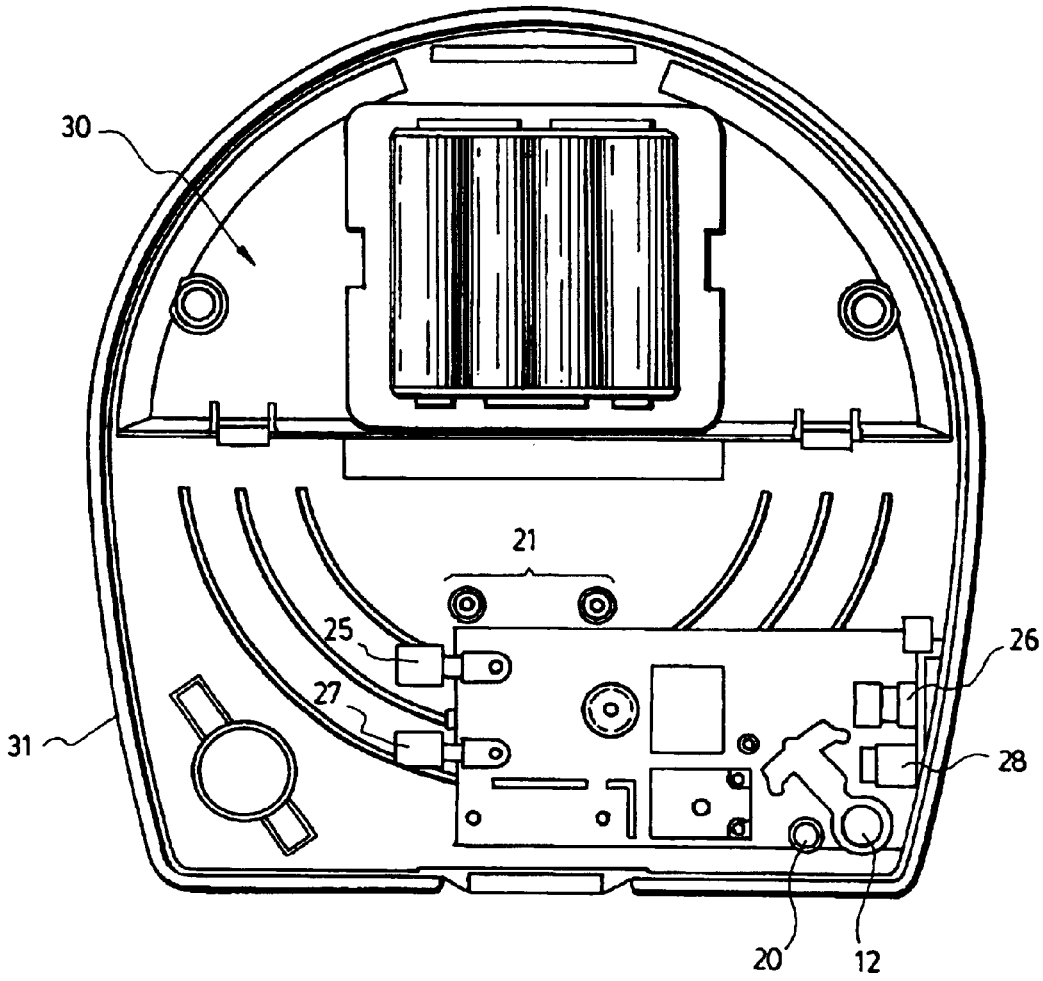
FIG. 4 is an inside view of a casing for the security system according to a preferred embodiment of the invention.

Referring to FIG. 4, there is shown how the components of the alarm system according to the present invention may advantageously be installed in a casing 31. Such an embodiment makes the system 10 very convenient to install, carry or sell. Preferably, the casing 42 is round shaped, and is provided with an inner cavity 30 in which the fiber loop 24 may be stored when the system is not in use.

Figure 3:
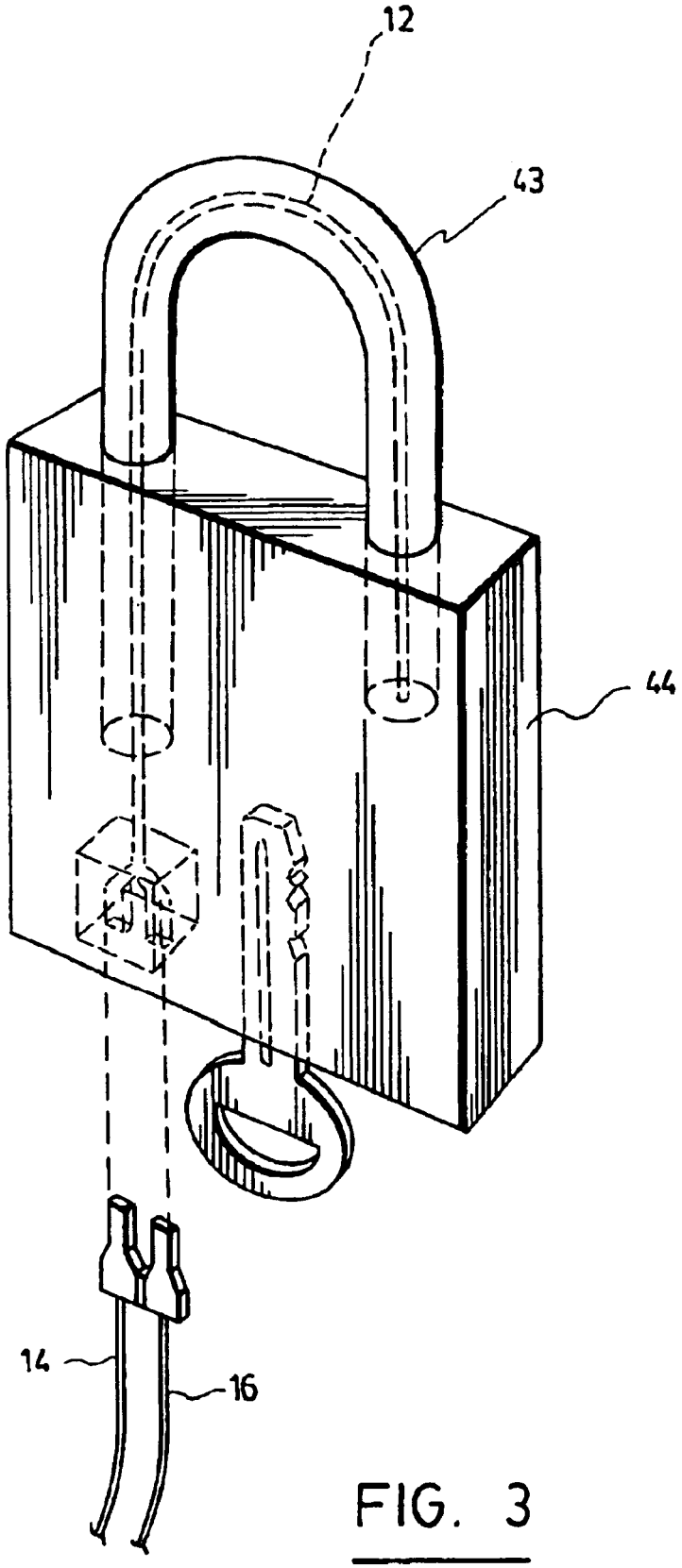
FIG. 3 is a schematic representation of the security system of FIG. 1 incorporated into a link of a padlock.

Referring to FIG. 3, there is shown another embodiment of the invention where the fiber loop 24 is hidden into the link 43 of a padlock 44. In this manner, cutting the padlock would also cut the fiber optic loop, therefore activating the alarm. In such an embodiment, the padlock 44 is also provided with a connector 38 for connecting the balance of the optical fibre thereto.

It should also be understood that the electronics and optical components of the present invention can be advantageously embodied in integrated circuits, and other electronic components, but that the invention is not limited thereto.

Although the present invention has been described by way of a preferred embodiment thereof, it should be understood that modifications within the scope of the invention are contemplated by the present application.

What is claimed is:

1. A fibre optic based security system, comprising:

a length of optical fibre having two opposite ends and adapted to be looped about at least one object to be protected; and a portable casing comprising:

a light emitter optically coupled to one of the opposite ends of said fibre for injecting light therein;

a light detector optically coupled to the other of said opposite ends of the fibre for detecting a level of light transmitted by said fibre;

threshold means connected to said light detector for determining if the level of light transmitted by the fibre is below a predetermined threshold level;

a power source for powering said system; and an alarm operatively associated with said threshold means, said alarm being triggered when said level of light transmitted by said fibre falls below the threshold level;

characterized in that said length of said optical fibre is such that when said fiber is looped about said object to be protected, said portable casing is placed at an area remote from said object and physically separated therefrom by a barrier, so that said casing is not accessible from an area where said object is located.

2. A fibre optic based security system according to claim 1, wherein said alarm is a visual alarm.

3. A fibre optic based security system according to claim 2, wherein said visual alarm includes a LED.

4. A fibre optic based security system according to claim 1, wherein said alarm is an audible alarm.

5. A fibre optic based security system according to claim 1, wherein said alarm is a visual and audible alarm.

6. A fibre optic based security system according to claim 1, wherein said power source includes a conventional electrical outlet.

7. A fibre optic based security system according to claim 6, wherein said power source further includes a backup battery.

8. A fibre optic based security system according to claim 2, wherein said system includes an output for an external loudspeaker.

9. A fibre optic based security system according to claim 1, wherein at least a portion of said optical fibre is integrated in a link of a padlock and is connectable to a balance of said fibre through a connector integrated with said padlock.

10. A fibre optic based security system according to claim 1, wherein said light emitter, said light detector, said threshold means and said alarm are integrated into an electronic circuit.

11. A fibre optic based security system according to claim 1, wherein said light emitter is a LED.

12. A fibre optic based security system according to claim 1, wherein said optical fibre is made of glass or plastic.

13. A fibre optic based security system according to claim 1, wherein said system further includes a LED for indicating proper functioning of said system.

* * * * *